US006010032A

United States Patent [19]

Vermylen et al.

[11] Patent Number: 6,010,032

[45] Date of Patent: Jan. 4, 2000

[54] CONTINUOUS DISPENSING SYSTEM FOR LIQUIDS

[75] Inventors: Dirk Vermylen, Edegem; Alexander Berkhout, Lier, both of Belgium

[73] Assignee: Emes N.V., Belgium

[21] Appl. No.: 09/099,694

[22] Filed: Jun. 18, 1998

[30] Foreign Application Priority Data

Jun. 19, 1997 [EP] European Pat. Off. ..... 97870089

[51] Int. Cl.[7] ..... B67D 5/08

[52] U.S. Cl. ..... 222/1; 222/55; 222/63; 222/64; 222/144.5

[58] Field of Search ..... 222/1, 55, 63, 222/64, 144.5

[56] References Cited

U.S. PATENT DOCUMENTS

| | | | |
|---|---|---|---|
| 3,712,335 | 1/1973 | Wiebe | 222/144.5 X |
| 3,830,405 | 8/1974 | Jaeger | 222/144.5 X |
| 3,972,449 | 8/1976 | Smith | 222/64 |
| 4,019,653 | 4/1977 | Scherer et al. | 222/144.5 X |
| 4,417,610 | 11/1983 | Waldström et al. | 222/55 X |
| 4,710,993 | 12/1987 | Whaley | 8/158 |
| 4,998,672 | 3/1991 | Bordaz et al. | 239/585 |
| 5,238,191 | 8/1993 | Gaymon | 222/63 X |
| 5,310,114 | 5/1994 | Cann | 239/74 |
| 5,316,181 | 5/1994 | Burch | 222/144.5 X |
| 5,332,125 | 7/1994 | Schmitkons et al. | 222/63 X |

FOREIGN PATENT DOCUMENTS

| | | | |
|---|---|---|---|
| 0403280A2 | 12/1990 | European Pat. Off. . | |
| 0492752 | 12/1991 | European Pat. Off. | D06B 23/20 |
| 0636959A2 | 2/1995 | European Pat. Off. . | |
| 2611059A1 | 8/1988 | France . | |
| 3925016A1 | 1/1991 | Germany . | |
| 4413249 | 10/1995 | Germany | B05D 1/34 |
| 59-050316 | 3/1984 | Japan . | |
| 632840A5 | 10/1982 | Switzerland . | |
| 1486418 | 9/1977 | United Kingdom . | |
| 2066707A | 7/1981 | United Kingdom . | |
| 2260965A | 5/1993 | United Kingdom . | |
| WO9824629 | 6/1998 | WIPO | B41F 31/00 |

OTHER PUBLICATIONS

Beaud, Translated abstract for CH 632840 A, Oct. 29, 1982.

Patent Abstracts of Japan, Publication No. 59050316, Publication Date Mar. 23, 1984, Koike Tamotsu, English translation.

*Primary Examiner*—Andres Kashnikow
*Assistant Examiner*—Sean P. O'Hanlon
*Attorney, Agent, or Firm*—Jack V. Musgrove

[57] ABSTRACT

The present invention relates to the continuous production of coated, dyed, printed, or painted materials by dip coating, spraying or printing in which a plurality of flowable materials including a liquid color concentrate are fed to a continuous mixing chamber with a substantially continuous input and output. The liquid color concentrate is dispensed by a dispensing apparatus including at least a first substantially vertical hollow chamber; a controllable pump device having an inlet fluidly connected to an outlet of said first hollow chamber for pumping the liquid color concentrate to the mixing chamber; a sensor for outputting substantially continuously a signal dependent upon a height of a liquid in the first hollow chamber; and a control device suitable for controlling at least one flow rate determining characteristic of the controllable pump in response to the output signal of the sensor so as to maintain the flow rate of the liquid to be dispensed through the pump device at a predetermined value. The method and apparatus are particularly useful in the manufacture of printed carpets.

20 Claims, 7 Drawing Sheets

CONTINUOUS DISPENSING SYSTEM FOR LIQUIDS

The present invention relates to a method of controllably and continuously dispensing liquids, particularly the dispensing of small or micro-quantities of liquids in a full scale industrial process, and to an apparatus for carrying out the method. The apparatus and method in accordance with the present invention are particularly useful for use in the continuous coating of materials e.g. printing or painting of carpets, textiles or spray painting or printing of other large objects.

TECHNICAL BACKGROUND

There are many processes which require not just the measurement but also the controlled dispensing of small quantities of one or more materials into a larger amount of fluid or powder. It is usually convenient to add these materials as additive liquids because liquids are easier to dispense accurately than powder or other forms of solid material. For instance, in the manufacture of coated, dyed, printed, or painted, e.g. spray painted, materials, e.g. textiles by dip coating, spraying, printing etc., amounts of certain chemicals may be added to the bulk coloring material to provide additional functions, such as anti-fungus or anti-bacterial additives, antioxidants, stabilizers including UV-absorbers, surfactants, chemical or stain resistance ar water resistance (water proofing) agents, viscosity controllers, pH regulators, cross-linking agents or similar additives. Similarly, in the pharmaceutical or the food making industries micro-amounts of chemicals may be added to provide specific functionalities. Some of these additive liquids may be expensive or environmentally detrimental and therefore there is a general need to prevent excessive use or waste of these liquids Hence, it is advantageous to dispense the liquids as exactly as possible and also to provide means for reducing waste even in emergency conditions or during malfunction of the processing equipment. Further, in systems in which many liquids: are mixed together before processing, the mixed materials and partly processed materials often cannot be reused so that they must be disposed of and become waste. Hence, it is desirable to mix only small volumes of the materials together, so that on interruption of the process only small volumes of waste materials are involved. However, mixing small quantities together means that it is more difficult to maintain exact dosing as the absolute tolerances reduce in proportion to the amount mixed. For instance, when mixing colors, it is easier to maintain a stable color if larger quantities are mixed together and one batch of color is used for one production run. Further, if. very small quantities of liquids are dispensed, the flow rate of the liquid may drop below that which can be metered satisfactorily by commercially available metering systems such as metering valves. In general, commercially available metering systems become inaccurate at flow rates below 5 liters per hour.

CH-A-632 840 describes a device for controlling liquid flow which includes a measuring cylinder and a pump connected thereto. The height of the liquid in the cylinder is measured and the pump is controlled based on the calculated rate of change of height in the cylinder compared with a predetermined value. No indication is provided of how this device may be used in a paint, ink, dye or colored paste printer or sprayer or dyeing equipment.

EP-A-636 959 describes a hybrid analogue and binary flow control device in which an analogue fluid line containing a flow rate regulator is connected in parallel with binary fluid lines which each contain an on-off(binary) valve and a precision orifice. The binary lines have a sequential order of increasing predetermined flow rates. This known device is complex and requires very careful adjustment and maintenance. It is designed for laboratory instruments and is unsuitable for industrial processes.

GB-A-2 260 965 describes a metering and dispensing system for dispensing liquids with small flows. A pair of vertical metering tubes provided with level sensors are alternately filled and emptied. The sensors are spaced apart along each tube so as to indicate the passage of a known volume of liquid. The time taken for the liquid surface to move from one sensor to the other combined with the knowing volume expelled allows calculation of the flow rate of the liquid. Feed back control is provided so that if the time taken for the liquid to travel from one sensor to the other is too short or too long, the input pressure of the liquid to the tubes is reduced or increased respectively. One disadvantage of this system is that a knowledge of how much material has been dispensed can only be calculated discontinuously at the end of each emptying cycle. Such a system may be subject to hunting, i.e. that the feed back control system over compensates and under-compensates alternatingly so that the system never reaches stability and never gives a continuous flow. Further, the system cannot react to changes in flow during one cycle. The system reaction time can be reduced by reducing the volume in the tubes between the two level sensors. However, this has the disadvantage that the range of flow rates which can be dispensed accurately is reduced or that the same accuracy cannot be obtained over the whole range.

U.S. Pat. No. 4,906,165 describes a flow meter for use with a positive displacement pump or a gravity feed. The flow meter is connected to a positive head of liquid in order to charge a volume float chamber. The volume float chamber is a vertical tube. The volume float chamber is also connected to the suction side of a pump. Once the chamber is charged, the pump draws liquid from the chamber. Level sensors are used to measure the time taken for the liquid level in the chamber, as indicated by a float, to drop from a first to a second level and from this value the flow rate is calculated. During the time that the chamber is refilled the pump is switched off The average flow rate over one cycle is determined by extrapolating from the measured portion of flow to the complete time the liquid has been flowing. This known device does not control the flow continuously and suffers from having no feedback control.

U.S. Pat. No. 4,597,507 describes an apparatus for metering and feeding a solution which includes a container, an inlet valve for feeding solution into such container, and an outlet valve for allowing the solution fed into the container to flow out. A pressure transducer connected to the container measures the static head of the solution and outputs a signal proportional to the volume of solution in the container. A control device responsive to the output of the transducer closes the inlet valve when a predetermined volume of solution is reached and opens the outlet valve to allow gravity feed discharge of the solution. This known device has the disadvantage that the flow is discontinuous. The average flow rate is only adjustable by increasing or decreasing the delay between cycles resulting in a pulsed discharge. This reduce., the range of flow rates which can be dispensed effectively. The device works best when only a single flow rate is required. Further, as gravity feed is used, the range of viscosities of the solution and the output pressure of the known device is restricted.

Still another problem may be caused by non-linearities in the system. One source of non-linearity may be the liquid to be dispensed, e.g. if it is a thixotropic material or a material whose viscosity changes with the degree of sheer it has experienced. Other sources of non-linearity may be provided by the devices of the system such as pumps or valves with which the dispensed flow rate may depend upon the inlet or outlet pressure of the device or the difference between these two or on other factors. One approach to compensating for non-linearity is given in EP-A-403 280. In this known method the properties of the non-linear component (here, the liquid) are measured and recorded in a calibration phase. Tests are carried out over the likely useful range and a plurality of discrete points of differing flow values are measured and stored in a computer in the form of tables. During use the required value is looked up in the tables in the computer. If the required value lies between two previously calibrated values, the computer calculates some intermediate value in accordance with an interpolation routine. This known system has serious disadvantages when a plurality of liquids are to be dispensed. The number of points which have to be stored in the computer can be so great that the computer system becomes expensive and slow. Further, it is necessary to calibrate across the complete range of likely values even when some of these are never used later. This means that the system takes a long time to set up and is riot very flexible.

FR-A-2 611 059 describes a batch processor for dyeing textiles. The colored dye composition is created in a batch in a large vessel and is dispensed to a reaction chamber via a controllable valve which is controlled in accordance with the measured height of the dye composition in the vessel. If the process has to be stopped a large volume of colored dye left in the vessel must be disposed of In the manufacture of carpet it is known to print the design onto the carpet rather than to weave it using different colored yarns. Such printing systems are many times faster than weaving. Such carpet printing systems dispense the color to the printing heads in the form of a paste. A high viscosity paste is necessary as there may be no movement of the color on the carpet after the printing process. Hence, the color paste must have sufficient stiffness that it does not migrate.

U.S. Pat. No. 4,403,866 describes a method of making paints in which a computer is used to control a multiplicity of metering pumps that are each individually connected to supplies of the paint components such as binder solution, solvent and colorants. The components are mixed and then circulated through a recycle loop in which a colorimeter checks the color value of the paint and feeds the results back to the computer. Any difference between the required and actual color is compensated for by the computer by adding more or less colorant. The procedure works best as a batch process, i.e. a quantity of paint is made and then checked. Adjustments are made until the required color is obtained and then the batch of paint is used. This known method has the disadvantage that after a machine malfunction, the large quantity of mixed paint in the mixing vessel may have to be discarded. Further, there are errors in colors which cannot be compensated for by the proposed technique without discarding some paint. e.g. if one of the color components is in a considerable excess it may be impossible to compensate for the error by the addition of other colors.

A batching method for paints is described in U.S. Pat. No. 4,705,083 which is supposed to achieve accuracy better that 1%. The method involves the operator in checking by hand the amount of any component delivered by a displacement pump driven by a stepping motor. Once the operator is satisfied that the correct flowv rate has been obtained, the machine is run. No method is described of how to maintain quality during a run.

Yet a further system of batching paint is known from EP-A-690 294 in which the quantity of paint of one color transferred to a mixing vessel is determined by a gravimetric scale supporting the mixing vessel. When a particular color is not being transferred to the mixing vessel, the paint is recirculated to prevent sedimentation.

It is an object of the present invention to provide an apparatus and a method of continuously, controllably and accurately dispensing liquids in an industrial apparatus for printing, dyeing, dip coating or spraying colors even at low flow rates, particularly to dispense liquids with a flow rate error of less than 5% at a flow rate as low as 0.33 ml per minute over long periods.

It is a further object of the present invention to provide an apparatus and a method for continuously, controllably and accurately dispensing liquids over a wide range of flow rates, preferably over a range of 1 to 100 times.

It is a further object of the present invention to provide an apparatus and a method for an industrial process, in particular printing of carpets, in which a plurality of liquids and optionally other flowable materials are mixed together continuously and accurately.

SUMMARY OF THE INVENTION

The present invention includes an apparatus suitable for use in the continuous manufacture of coated, dyed, printed, or painted materials by dip coating, spraying or printing, said apparatus forming a colored flowable material from at least one liquid color concentrate and a plurality of other flowable materials comprising-,:

a plurality of conduits for feeding substantially continuously the flowable materials and the liquid colored concentrate from sources of the flowable materials and the liquid colored concentrate to a substantially continuous mixing chamber having a substantially continuous output of the colored flowable material;

at least the conduit carrying said liquid color concentrate to said mixing chamber including:

at least a first substantially vertical hollow chamber connected to the conduit; a controllable pump device for pumping the liquid color concentrate having an inlet fluidly connected to an outlet of said first hollow chamber and an outlet leading to said mixing chamber;

a sensor for outputting substantially continuously a first signal dependent upon a height of a liquid in said first hollow chamber; and a control device for determining from said first signal whether the, flow rate of the liquid from said first hollow chamber is above or below a predetermined value and for controlling at least one flow rate determining characteristic of said controllable pump device in response to this determination so as to maintain the flow rate of the liquid color concentrate to be dispensed through said pump device at the predetermined value.

The present invention may also include an apparatus for dispensing a liquid comprising:

a source for the liquid to be dispensed; at least a first substantially vertical hollow chamber fluidly connected to said liquid source;

a controllable pump device having an inlet fluidly connected to all outlet of said first hollow chamber for pumping the liquid to be dispensed;

a sensor for outputting substantially continuously a first signal dependent upon a height of a liquid in said first hollow chamber;

a control device suitable for determining from said first signal whether the flow rate of the liquid from said first hollow chamber is above or below a predetermined value and for controlling at least one flow rate determining characteristic of said controllable pump device in response to this determination so as to maintain the flow rate of the liquid to be dispensed through said pump device at the predetermined value, a closed loss-free loop between the output of said controllable pump device and an inlet to said first hollow chamber for training or calibration, and a diverting means for diverting the flow of liquid from the close loop of said dispensing apparatus to an outlet without substantially changing the operation of said dispensing apparatus.

The present invention may also include an apparatus for dispensing a liquid comprising: a first substantially vertical hollow chamber;

a second vertical hollow chamber fluidly connected to said at least one substantially vertical hollow chamber, said second chamber having a different cross-section than said at least one substantially vertical hollow chamber;

a controllable pump device having an inlet fluidly connected to an outlet of said first hollow chamber for pumping the liquid to be dispensed;

a sensor for outputting substantially continuously a first signal dependent upon a height of a liquid in said first or second hollow chamber; and a control device suitable for determining from said first signal whether the flow rate of the liquid from said first hollow chamber is above or below a predetermined value and for controlling at least one flow rate determining characteristic of said controllable pump device in response to this determination so as to maintain the flow rate of the liquid to be dispensed through said pump device at the predetermined value.

The invention also includes a method suitable for use in the continuous manufacture of coated, dyed, printed, or painted materials by dip coating, spraying or printing including forming a colored flowable material from at least one liquid color concentrate and a plurality of other flowable materials, comprising the steps of:

feeding the flowable materials and said liquid colored concentrate substantially continuosuly to a substantially continuous mixing chamber with a substantially continuous output of the colored flowable material;

dispensing said liquid color concentrate to said mixing chamber by the steps of:

filling at least one substantially vertical hollow chamber with a liquid, generating substantially continuously a first signal dependent upon a height of a liquid in said substantially vertical hollow chamber;

determining from said first signal representative whether the flow rate of the liquid from said first hollow chamber is above or below a predetermined value;

operating a controllable pump device to reduce the level of liquid in the at least one substantially vertical hollow chamber; and controlling at least one flow rate determining characteristic of said controllable pump device in response to said determination so as to maintain the flow rate of the liquid colored concentrate to be dispensed through said pump device at the predetermined value.

The invention also includes a system for dispensing a liquid, comprising:

a source for the liquid to be dispensed;

a dispensing device for controllable dispensing of the liquid; the dispensing device having a closed loss-free loop for training or calibration; and diverting means for diverting the flow of liquid from the close loop to an outlet without substantially changing the operation of said dispensing device.

The invention also includes a method of dispensing a liquid to an outlet using the above dispensing apparatus, comprising:

calibrating or training the dispensing apparatus using the closed loss-free loop; and diverting the flow to the outlet from each dispensing apparatus without substantially altering the operation of the dispensing apparatus.

The present invention also includes a fluid flow measuring device including:

a fluid inlet and a fluid outlet;

at least one substantially vertical hollow chamber, the lower end of said chamber being fluidly connected to at least said outlet;

a pressure sensor for outputting substantially continuously a signal dependent upon a height of a liquid in said chamber; and a pulsation damper fluidly connected to said chamber and to said pressure sensor.

The dependent claims define individually and particularly further embodiments of the invention. The invention with its embodiments and advantages will be described in the following with reference to the following drawings.

DESCRIPTION OF THE ILLUSTRATIVE EMBODIMENTS

In the following the present invention will be described with reference to specific embodiments and with reference to the drawings but the invention is not limited thereto but only by the claims. The drawings are only schematic representations and are non-limiting. In particular, certain dimensions may be exaggerated for clarity purposes. The present invention will be described with reference to the specific application in carpet printing but the invention is not limited thereto. In particular, the present invention may be used with any suitable process of dispensing liquids, particularly those involving mixing of flowable materials, e.g. printing, coating, painting, including spray painting of objects as well as chemical manufacturing processes.

Figure 1:
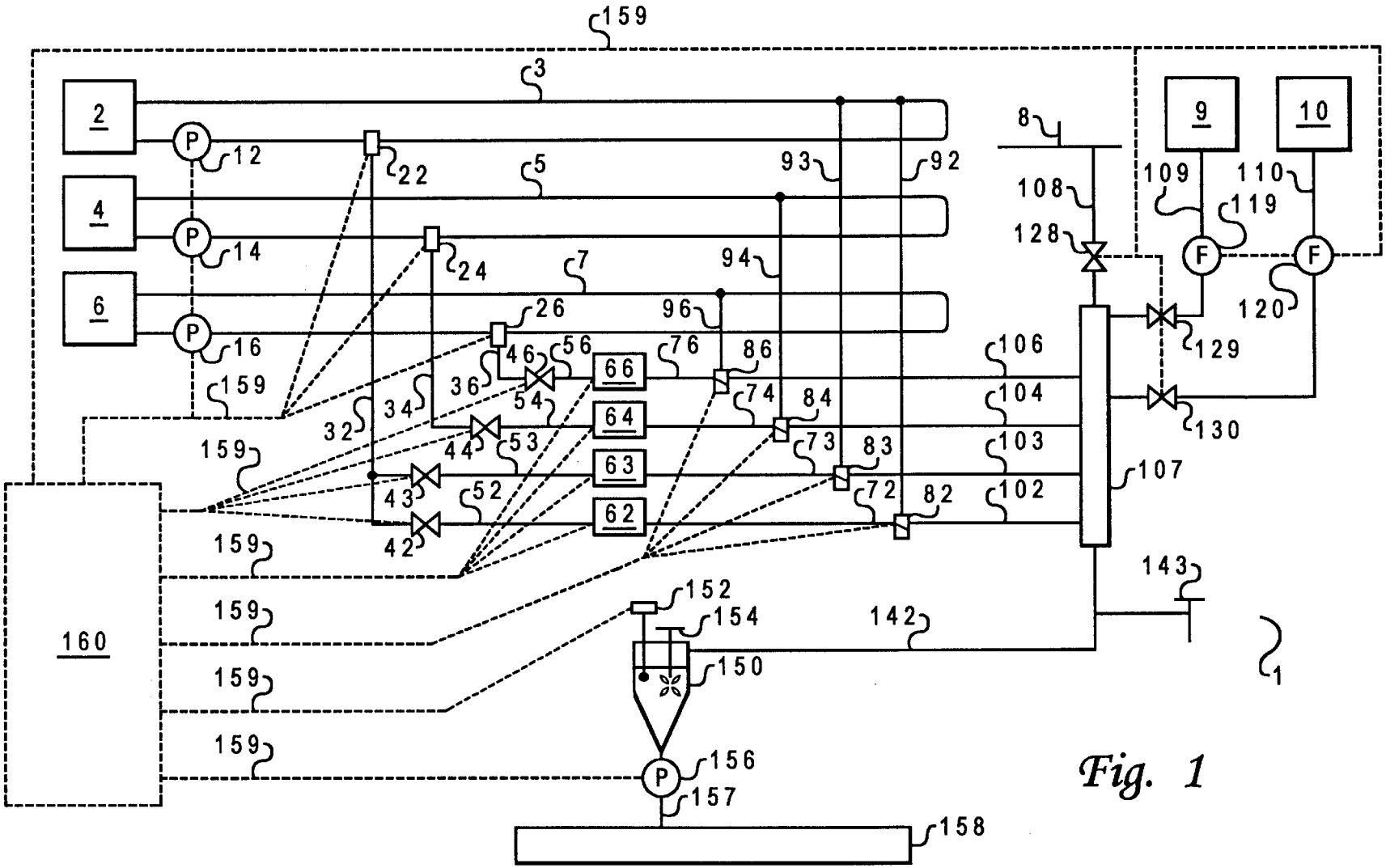
FIG. 1 is a schematic representation of an apparatus for controlling the printing of carpets in accordance with an embodiment of the present invention.

FIG. 1 is a schematic diagram of part of an apparatus 1 for controlling the printing of carpets in accordance with the present invention. Details of the pipework including sensors, return valves, joints etc. which are nor relevant to the present invention are not shown. The apparatus 1 shown in FIG. 1 provides one finished color paste to a printing head 158 for printing one color onto the carpet. For the other colors similar parallel systems may be used. The input to the system is provided by raw material supply containers 2, 4, 6, 9, 10 as well as a cleaning liquid supply line 8. The number of supply containers is determined by the number of discrete materials which must be included within the final paste. Output of the system is a color paste from container 150 which is pumped to the printing head 158 by a purring 156. The system includes a control device 160 which may include several individual parts working together or independently. Control system 160 is connected to the various devices to be sampled and/or controlled by lines which are represented schematically as dotted lines 159 in FIG. 1. Typically control system 160 will include one or more computers or microprocessors running software programs for control of the apparatus 1 but the invention is not limited thereto. Control system 160, for instance, may include, at least in part, hydraulic or pneumatic logic circuits. The carpet printing system in accordance with the present invention includes a first substantially continuous mixing chamber 107 in which the materials are mixed together for the first time and discharged substantially continuously to conduit 142 as long as materials are input to the mixing chamber 107. Mixing chamber 107 is preferably of small volume. The mixed materials are then transferred to a second mixing chamber 150 which may be larger in volume than the first mixing chamber 107 and may act as a homogenizer for the mixed materials as well as storing a buffer quantity of the color paste. The volume of mixed paste in the first mixing chamber 107, the pipework 142 leading to the second chamber 150, the second chamber and the pipework leading therefrom to the printing head 158 is preferably kept to a minimum so that the volume of mixed paste at any time is kept low.

The flow rate of the liquid materials supplied from containers 2, 4, 6 to first mixing chamber 107 is controlled by dispensing apparatus 62, 63, 64, 66 in accordance with the present invention. In accordance with the present invention the term liquid materials also includes all forms of liquid materials, e.g. dispersions, colloidal solutions, suspensions and emulsions. The viscosity of the liquid materials controlled by the dispensing devices 62, 63, 64, 66 according to the present invention preferably lies in the range less than 10,000 cps, more preferably less than 4,000 cps. Typical liquids used for a recipe for color paste in carpet printing in accordance with the present invention are one or more of pH stabilizers, acids or alkalis, viscosity improvers, fixation agents, antifoaming agents, UV-stabilizers, as well as color concentrates.

Optionally, flowable materials may be supplied from containers 9 and 10 and controlled by controllable metering devices 119, 129 and 120, 130) respectively which may optionally include metering pumps. Flowable materials supplied from containers 9 and 10 may be materials which are supplied in larger quantities, e.g. at a flow rate greater than 5 liters per hour. These flowable materials may be liquids but can also be powders, pastes, slurries or any flowable material which can be transferred and mixed with the liquids from containers 2, 4, and 6.

Preferably, the liquids in containers 2, 4, 6 are pumped continuously around a closed loop 3, 5, 7, respectively to prevent sedimentation of any solid materials or to prevent separation of phases. In each of the lines 3, 5, 7 controllable valves 22, 24, 26 are located. When closed the valves 22, 24, 26 allow flow around the closed loops. When the valves 22, 24, 26 are open they allow both circulation around the closed loops 3; 4; 5 and also supply of the respective liquid to controllable valves 42, 43; 44; 46 respectively. Controllable three-way valves 22, 24, 26 are preferably all under the control of the control system 160. Controllable flow valves 42, 43, 44, 46 may be hand operated or optionally are all under the control of the control system 160 and are used to set a flow rate in the lines 32, 34 36 which slightly exceeds th(e maximum requirements of any of the dispensing devices 62, 63, 64 and 66, respectively. Controllable metering devices 119, 129 and 120, 130 are provided in the lines 109 and 110, respectively between the containers 9 and 10 and the mixing chamber 107. For instance flow meters 119, 129 may provide feedback signals for I he flow control of controllable valves 120, 130, respectively. Suitable electronic flow meters may be obtained from Endress & Hauser, Weil am Rhein, Germany. Suitable high accuracy controllable valves may be obtained from Masoneilan-Dressser, Neuilly sur Seine, France. For a given recipe for a particular color paste, the required flow rates of liquids and flowable materials are stored in tables in the control system 160, e.g. in a memory of a computer.

Initially, the control system 160 preferably sends actuating signals to the relevant ones of controllable valves 22, 24, 26, 42, 43, 44, 46 to provide flow to the relevant ones of the dispensing devices 62; 63; 64; 66 via lines, 3, 32, 52, 3, 32, 53; 5, 34, 54 and 7; 36, 56 respectively. Dispensing devices 62, 63, 64, 66 are designed for a particular range of flow rates. When it is known that the possible flow rates of one liquid component exceeds the range of one dispensing device, two) or more dispensing devices 62, 63 may be provided for any one line 32. These two dispensing devices 62, 63 may contain pumps of different capacities capable of providing liquid in different flow rate ranges. The control system 160 selects the correct dispensing device 62, 63 depending upon the rate required for the specific recipe. The control system 160 also sends signals to the dispensing devices 62, 63, 64, 66 representative of the desired flow rates to be set by these devices. The control system 160 also sends actuating signals to relevant ones of the controllable three-way valves 82; 83; 84; 86 to divert the flow from the dispensing devices 62; 63; 64; 66 to the lines 3, 5, 7 respectively via lines 72, 92; 73, 93; 74, 94; 76; 96. In this calibration or training phase, the liquid materials are circulated loss-free through the dispensing devices 62, 63, 64, 66 back to the containers 2, 4, 6. This allows time for the temperatures, feedback systems, pumps and flow rates in dispensing devices 62, 63; 64; 66 to stabilize without loss of any materials to waste.

Once the dispensing devices 62, 63, 64, 66 are running smoothly, the control system 160 sends actuating signals to flow control devices 11, 129 and 120, 130 to start supply of controlled quantities of the flowable materials from containers 9, 10 to the first mixing chamber 107. At substantially the same time, control signals are sent to the three-way valves 82, 83, 84, 86 to divert the flow of materials from loss-free closed loop calibration or training to the first mixing chamber via lines 101, 103, 104, 106, respectively. This diversion is made without change, e.g. without change of speed, without stopping and without reversal, of the pumps in dispensing devices 62, 63, 64, 66 which has the advantage that the dispensing devices 62, 63, 64, 66 suffer the least possible change from the calibration or training phase to the processing phase. If necessary, e.g. if the mixing chamber 107 is under high pressure, the liquids in lines 102, 103, 104, 106 may be injected into first mixing chamber 107 by injectors (not shown). As at least some of the liquids may react chemically with each other and/or with the flowable materials from containers 9 and 10, the order of entry into the mixing chamber 107 may be important. Preferably mixing chamber 107 is an elongate chamber and at least one of the flowable materials may be introduced at one end. The entry points for other flowable materials and liquids can then be staggered along the length of the chamber 107 in order to obtain a sequenced mixing of materials. The mixing chamber 107 differs from conventional batch systems as it discharges mixed materials to conduit 142 substantially continuously as long as component materials are input to it.

Typically, at least one of the flowable materials from containers 9, 10 is a high viscosity thickener paste, e.g. a starch paste, and one of the flowable materials is a solvent such as water for controlling the viscosity and color depth of the final paste mix. Mixing chamber 107 may be a simple pipe. Mixing devices may be provided in mixing chamber 107 to enhance homogenization. For example, mixing chamber 107 may be the barrel of an extruder in which a longitudinal rotating s(crew transports the materials towards the outlet of the chamber 107 and at the same time mixes the materials. Counter-rotating screws may be provided to improve mixing.

The mixed paste exits from the mixing chamber 107 and is transported to the second mixing chamber 150 via line 142. If required, a sample of the mixed paste may be taken from a tap 143 and examined for color, viscosity etc. and any necessary changes to the system carried out before processing begins. In mixing chamber 150 the paste may be further homogenized, e.g. by a screw or stirrer 154. The height of the paste in chamber 150 is detected by a, sensor 152 which sends a signal representative of the height back to the control system 160. If the quantity of paste in chamber 150 drops too low, e.g. below a lower predetermined height, the control system 160 sends signals to the dispensing devices 62, 63, 64, 66 and metering devices 119, 129, 120, 130 to speed up proportionally and increase flow through the first mixing chamber 107. Alternatively, if the height of paste in chamber 150 rises too high, the control system 160 sends appropriate signals to throttle back the flow of paste.

Finally, paste from chamber 150 is transferred to the printing head 158, optionally by a pump or flow rate control device 156 under control of the carpet printing equipment (not shown). If a temporary stop of the printing equipment is required, the control system 160 can, if necessary, close off flow from containers 9, 10 by closing valves 129, 130 and divert the flow of liquids in lines 72, 73, 74, 76 to the closed loops 3, 5, 7 by actuating valves 82, 83, 84, 86. By this means the pumps in the dispensing devices 62, 63, 64, 66 are not stopped and the complete system can be restarted instantaneously while maintaining accuracy. As the pumps in the dispensing devices 62, 63, 64, 66 are not stopped there is no risk of sedimentation in the dispensing devices or in the lines 32, 42, 52, 72; 32, 43, 53, 73 etc. To clean the system between colors it is only necessary to clean the mixing chamber 107, the conduit 142, the chamber 150 and the conduit 157. This can be done using the clean water supply 8.

In accordance with the present invention, the color for the final paste may be provided as a liquid concentrate from one of the containers 2, 4, e. This color concentrate is dispensed in accurate and small quantities to the mixing chamber 107 using one of the dispensing devices 62, 63, 64, 66. This has the advantage that in accordance with the present invention it is no longer necessary to mix large quantities of bulk color with the starch thickener. The color concentrate is mixed with the thickener in the mixing chamber 107 continuously. The necessary lilution of color is provided by adding the required amount of solvent from one of the containers 9, 10, e.g. Wader. Normally, the thickener and water make up more than 90% of the color paste, so that making batches of colored thickener creates large volumes which have to be stored and are difficult to re-use. In accordance with the present invention a liquid concentrate is used. Because it is a concentrate it has a small volume and can be easily stored and re-used.

Figure 2:
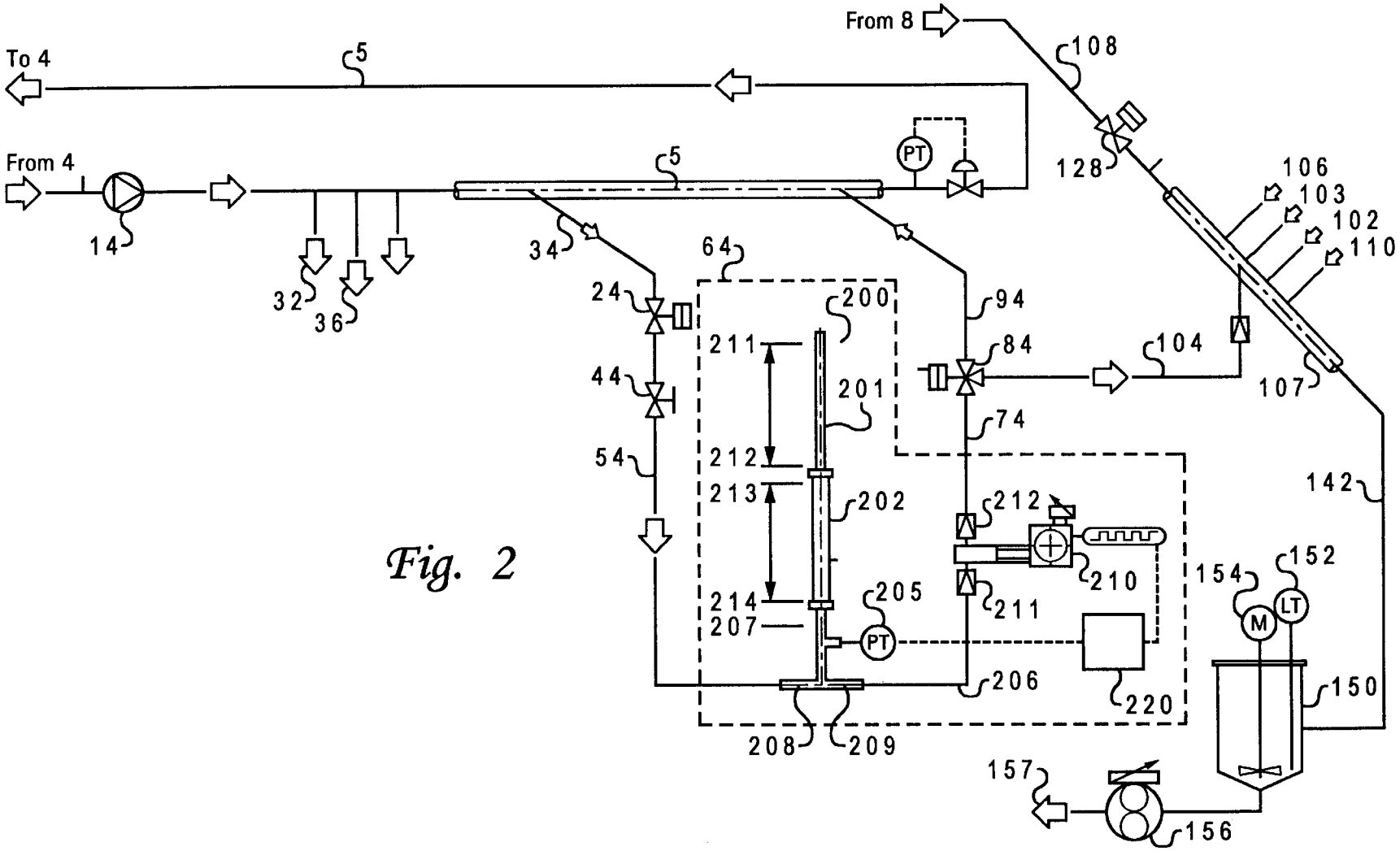
FIG. 2 is a detail of the apparatus shown in FIG. 1 showing schematically a dispensing device in accordance with an embodiment of the present invention.

FIG. 2 shows a detail of the system shown in FIG. 1 and is schematic representation of an embodiment of one of the dispensing devices 64 in accordance with the present invention. Components with the same reference numbers represent the same components as in FIG. 1. Dispensing device 64 includes a measuring device generally represented by the reference number 200 and a controllable pump device 210. Preferably, pump device 210 is a displacement pump. More preferably, pump 210 is a reciprocating piston dosing pump. Preferably, the stroke length and frequency of the piston is adjustable by a servo motor. Most preferably, the piston has a forced plunger return. Diaphragm metering heads are preferred. Suitable pumps may be obtained from Bran & Luebbe GmbH, Norderstedt, Germany.

Pump 210 is placed downstream of measuring device 200 and an inlet 211 of pump 210 is fluidly connected to an outlet 209 of measuring device 200 by means of a conduit 206. An inlet 208 of measuring device 200 is fluidly connected to the conduit 54. Outlet of pump 210 is connected to conduit 74. Pump 210 has at least one characteristic which can be adjusted to set a flow rate through the pump. For example, if the pump 210 is a displacement pump both the travel "T" and the frequency "F" of the pump may be varied individually or together to alter the flow rate through the pump 210. It is convenient but not necessary for the invention to gang all the pump drives of the dispensing devices 62, 63, 64, 66 together and drive them by a. single motor. In this case the frequency F is set by the speed of the motor for all the pumps 210. If an individual pump such as 210 of dispensing device 64 has to be adjusted independently of the other pumps in the devices 62, 63, 66 this can be done by altering the travel (T) of the piston.

Flow measuring device 200 includes a substantially vertical chamber 201. Chamber 201 is preferably elongate with a bore of constant cross-section at least over a portion thereof between two positions 211 and 212. Chamber 210 may be made of any suitable material, e.g. clear PVC pipe. For very accurate work, chamber 201 preferably is a precision tube made from a material with a low coefficient of thermal expansion, e.g. glass or quartz. Typical useful non-limiting dimensions of tube 201 are a length of between 300 and 1000 mm and an internal diameter of between 5 and 100 mm. Tube 201 is fluidly connected to inlet 208. Measuring device 201 also includes a sensor 205 for continuously outputting a signal representative of the height of a liquid in chamber 210. The signal from sensor 205 is supplied to the control system 160. Control system 160 may be centralized in, for example, a computer, but this is not necessary for the invention. For instance, the signal from sensor 205 may be sent to control system 160 for general control and to a local feedback control circuit 220 for feedback control of the pump 210.

The dispensing device 64 in accordance with the present invention operates in the following way in accordance with one embodiment of the present invention. Initially, pump 210 is idle. Valve 24 is opened and liquid flows down conduits 34, 54 from the closed loop 5 into the flow measuring device 200. The level of liquid rising up the chamber 201 is measured by sensor 205 and the sensor outputs a signal of the height of the liquid in the chamber 201. When the liquid reaches level 211 the control system 160 actuates valve 24 to close. The control system 160 sends a control signal to feedback control circuit 220 to set the pump frequency F at a predetermined value. At the same time control system 160 sends an actuating signal to valve 84 to direct liquid along conduit 94 to the conduit 5 for calibration or training of the pump 210. The feedback control circuit 220 sends a suitable signal to pump 210 to) provide an initial piston travel T. As valve 24 is closed, the pump pumps liquid out of measuring device 200 back to the conduit 5. The change in level of the liquid in chamber 201 is continuously monitored by the sensor 205. When the signal from the sensor 205 indicates that the liquid level has reached level 212, the control system 160 opens valve 24. As the pump 14 in conduit 5 has a-considerably greater capacity than the displacement pump 210, liquid rises in chamber 201 until it again reaches the level 211 at which point the valve 24 is closed automatically by the control system 160 in response to the signal from sensor 205 corresponding to the height 211. In accordance with the present invention, during the chamber filling phase, the feedback circuit 220 is disabled and the pump 210 continues with the last setting of F and T before filling was started. Liquid feed is provided to the pump 210 direct from line 34, 54. As soon as filling is complete, the feedback circuit 220 resumes control over pump 210. The filling of chamber 201 takes a relatively short time and the pump 210 maintains a sufficiently constant flow over this short time so that no significant flow-rate error occurs.

During the evacuating phase, as the level in the chamber 201 lowers, the sensor 205 continuously supplies the signal dependent upon the height of the liquid in chamber 201 to the feedback circuit 220. In accordance with one embodiment of the present invention feedback circuit differentiates this first signal to produce a second signal representative of the rate of change of height of the liquid in chamber 201 with time. This second signal is representative of the flow rate through the pump 210 and is used in accordance with the present invention to control the length of travel of the piston in pump 205 to maintain the flow rate at a predetermined level. This control can be done by conventional feedback control methods as are well known to the skilled person. In such conventional control systems the controlling signal, here the signal representing the rate of change of the height of the liquid in chamber 201 is compared to a predetermined value and the difference between the two determined (either positive, i.e. the flow rate is too high, or negative, i.e. the flow rate is too low). Based on this difference which is representative of the difference between the measured and set flow rate, the flow through pump 210 is controlled. Feedback control circuit 220 can be a separate electronic device local to pump 210 or may be implemented as a part of a centralized control system 160.

Figure 6:
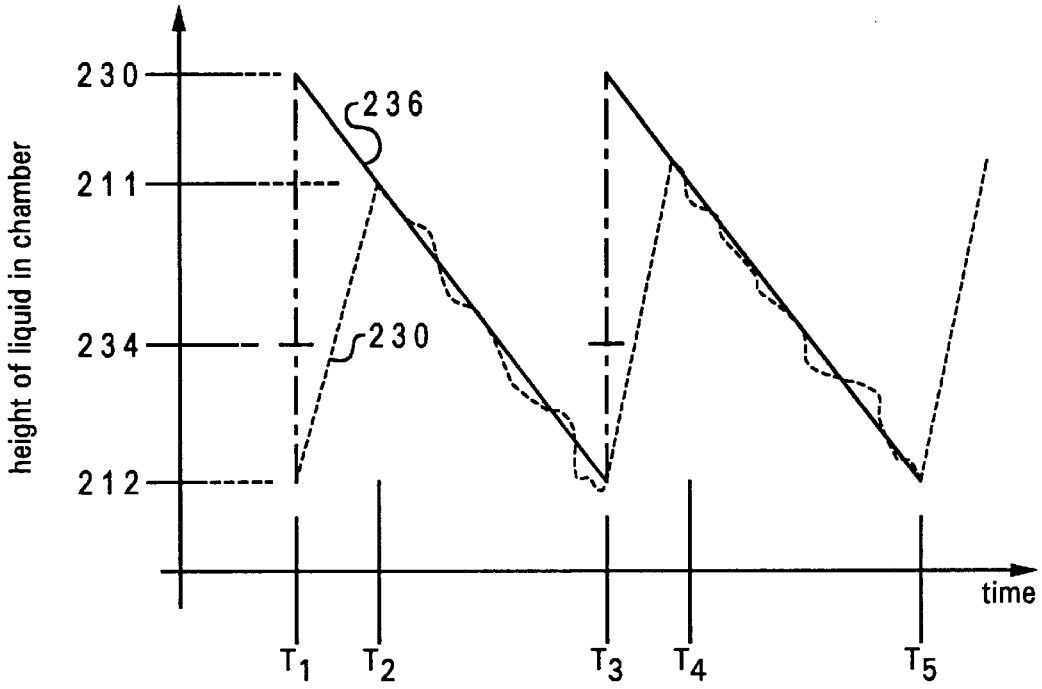
FIG. 6 is a schematic representation of a flow control procedure in accordance with one embodiment of the present invention.

An alternative embodiment of the present invention will be described with reference to FIG. 6. In this figure the dotted line 230 indicates the actual height of the liquid in the chamber 201 which oscillates between the lower and higher points 212 and 211. The control circuit 220 calculates a theoretical starting point 230 at the start $T_1$ of one cycle. The height 230 includes the difference in height between 212 and 211 plus the equivalent chamber height (234-212) of the liquid which has flowed between the times $T_1$ (start) and $T_2$ when the liquid has reached 211 in the chamber 201. Therefore, the height difference 230-234 is equal to the height difference 211-212. The control circuit estimates the height difference 234-212 based on the predetermined flow rate assuming this is maintained constant for the period $T_1$ and $T_2$ or bases the calculation on the measured flow rate for the time just before $T_1$. The control circuit 220 then calculates the theoretical height 236 of liquid in the chamber 201 as a function of time starting from height 230 assuming that the flow is the same as the predetermined level. At any time between $T_2$ and $T_3$ the control circuit 220 compares the theoretical value 236 with the actual measurement 230 ($\Delta h$). If the theoretical value 236 is higher than 230 then the flow rate is too high and the flow rate through pump 210 is reduced. If 236 is lower than 230 then the rate is too low and the flow rate through pump 210 needs to be increased. The cycle restarts at $T_3$.

During the calibration or training phase the actual flow rate may be checked additionally, e.g. by measuring the time taken to fill a standard volume. Any erroneous behavior can be recorded by the control system 160 and appropriate action taken, alternatively alarms activated. Any changes can be recorded by the control system 160, e.g. in tables stored in the memory of a computer. Once the dispensing device 64 is running satisfactorily, the control system 160 actuates valve 84 once the start signal from the printing equipment is received, and the flow is diverted smoothly into conduit 104 without interruption or change in operation of pump 210 or flow measuring device 200.

In accordance with the present invention, sensor 205 may be a pressure sensor located at a position lower than the chamber 201 and connected fluidly thereto. The output of the pressure sensor 205 may be a digital or an analogue signal representative of the pressure sensed by the pressure sensor 205. A pressure sensor 205 is particularly preferred because commercially available pressure sensors have a great accuracy and sensitivity. A suitable pressure sensor is a high accuracy dry cell pressure transmitter with an analogue output and programmable functions made by Vega Grieshaber KG, Schiltag, Germany. As the signal produced by the pressure sensor 205 is proportional to both the height and also the specific gravity of the liquid, changes in temperature do not alter the level of the signal output by sensor 205. Despite the fact that the liquid expands or contracts with change in temperature, the pressure sensed by the sensor 205 remains the same as the specific gravity reduces or increases proportionally to the volume change. Hence, the dispensing device 64 in accordance with this embodiment dispenses a constant weight of liquid per unit time. This is advantageous when the liquid to be dispensed undergoes chemical reactions which consume chemicals in the liquid based on their mass. In such cases it is the weight of chemical supplied which determines how the reaction completes. Hence, it is advantageous to supply a fixed weight. The dispensing device 64 in accordance with the present invention has achieved <3% error on a flow of liquid of 0.33 ml per minute over a period of 7 days.

In accordance with the present invention, sensor 205 may also be other height measuring devices. For example, the sensor 205 may be provided by a float on the surface of the liquid whose position is continuously monitored by a proximity sensor outside the chamber 201. For instance, a float may be attached to a magnetic rod which oves into and out of a solenoid as the level of the liquid moves up and down (not shown). The inductance of the solenoid is dependent upon the position of the rod in the solenoid and therefore also dependent upon the height of the liquid in the chamber. Alternatively, the position of the surface of the liquid in chamber 201 may be determined remotely, for instance by an ultrasonic surface level detector (not shown) as described in EP-A-459 755 which is incorporated herein by reference. Note that with the latter two height sensors 205, the output of the sensor 205 changes if the temperature of the liquid in the chamber 210 changes (thus resulting in expansion). Thus, the sensor 205 indicates a change in volume of the liquid and not a change in weight. Such a dispensing device 64 is preferably used when the volume of the liquid is critical for the successful completion of the process. Further, when sensor 205 is a pressure sensor, the dispensing device must be calibrated for each liquid having a different specific gravity. This is not necessary with a height sensor which measures the level directly as the signal from the sensor 205 is then independent of the specific gravity of the liquid to be dispensed.

In accordance with another embodiment of the present invention, a second chamber 202 may be provided which preferably has a larger cross-section than the chamber 201 and is located either above or below it (as shown in FIG. 2) or may be positioned independently, e.g. alongside chamber 201. The pump 210 is capable of pumping a variety of flow rates of liquid. The cross-section of the narrow tube 201 is determined by the slowest flow rate pumpable by pump 210. At this low rate the height of the liquid in tube 201 must still change fast enough that the signal from sensor 205 varies sufficiently to provide a parameter which allows accurate control. At the higher extremity of the pumpable range, the height of liquid in tube 201 can move so fast that tube 201 is rapidly empty. This causes valve 24 to switch on and off in quick succession and the control of pump 210 is impaired. To solve this problem, the measurement of liquid height is changed to within the region defined by the two upper and lower levels 213 and 214 in tube 202. As tube 202 has a larger cross-section, tie volumes or weights delivered before a refill is required is increased and the flow control system 200, 210, 220 behaves more accurately. The change from operating within tube 210 to tube 202 or vice versa can be automatically controlled by control system 160. The internal diameter of the second tube 202 may be typically 1.5 to 3 times the internal diameter of the first tube 201. In accordance with the present invention, additional tubes of different diameters may be added to cope with even larger flow ranges.

Figure 3:
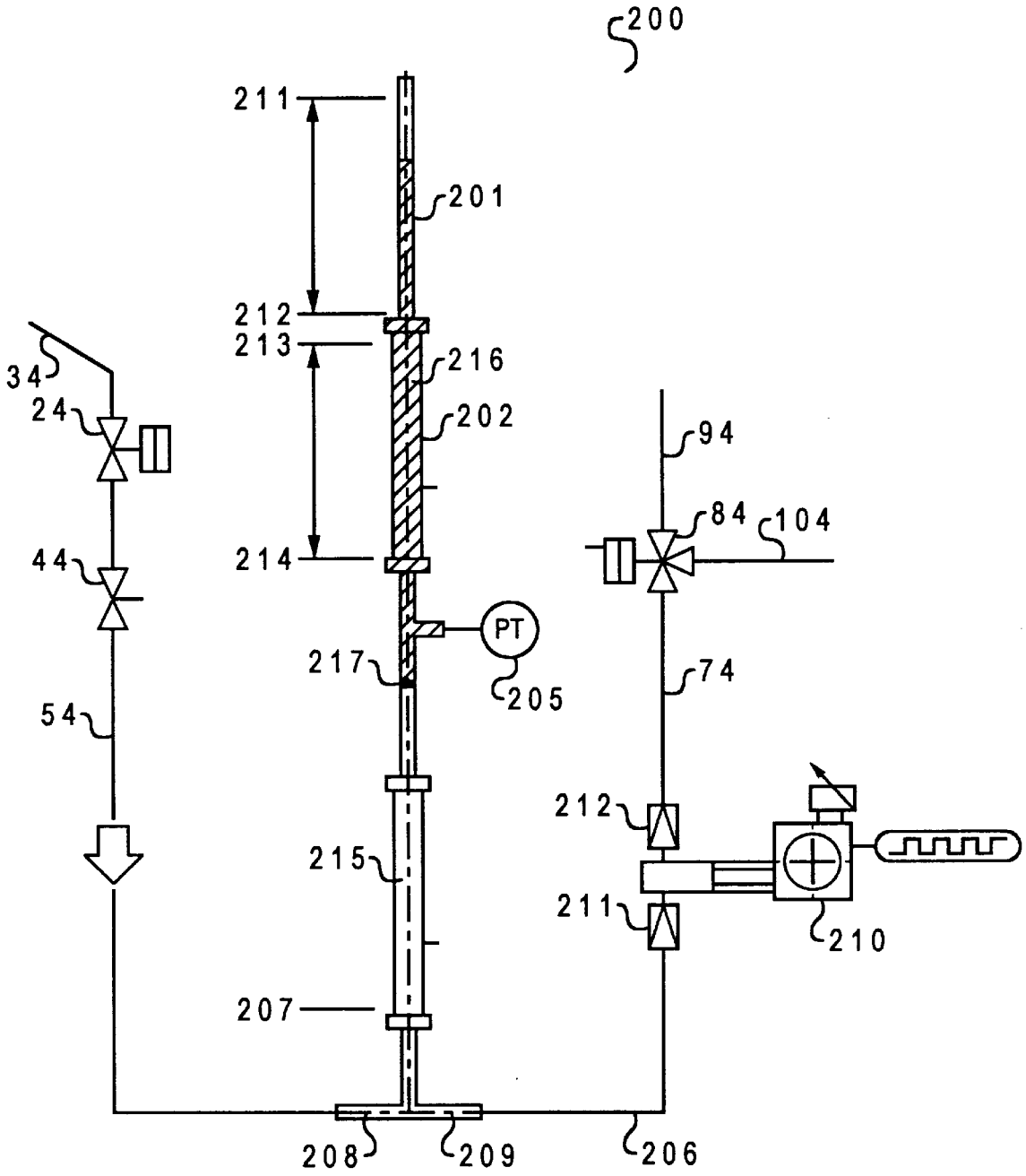
FIG. 3 is a schematic representation of another embodiment of a dispensing device in accordance with the present invention.

FIG. 3 is a schematic representation of a further embodiment of the measuring device 200 of a dispensing device 64 present invention. With the previous embodiment involving a pressure sensor 205, the dispensing device 64 must be calibrated for each liquid with a different specific gravity. This problem is solved by using a different liquid 216 on top of the liquid 215 to be dispensed. Liquid 216 is preferably inert and immiscible with liquid 215 and have a lower specific gravity so that it floats on liquid 215 an forms a stable meniscus 217. The pressure sensor 205 is located so that it measures the height of the liquid 216 and not 215. Thus, all changes of heights caused by flow of liquid 215 are recorded as the changes of height of the same liquid 216. The output of sensor 205 is independent of the specific gravity of the liquid 215 to be dispensed. The disadvantage of this embodiment is that the measuring device 200 is not self-priming with liquid 215. Instead, it may be important to make sure that the liquid 216 never enters pump 210. To avoid this, the control system 160 can be arranged to sound an alarm if the height of liquid 216 reaches a third level 207 and also to switch off pump 210.

In the above description of the embodiments of the invention, a single chamber 201 or a single combined chamber 201, 202 has been described. The invention is not limited thereto. A duplicate measuring device 200 may be provided with each pump and the other of the two measuring devices 200 can be used while the one device 200 is being filled. For instance, as shown in FIG. 1, two identical dispensing units 62, 63 may be used. While one 62 is filling the other 63 can be dispensing. After filling, the one 62 may continue with a training cycle, the liquid being fed back to line 3. As soon as 63 starts filling, the valves 82, 83 may be switched so that 62 feeds and 63 fills and trains.

With, reference to the embodiments of the present invention relating to the dispensing device 64 including a pressure sensor 205, it is preferred if the pressure sensor senses the pressure of the column of liquid in the chamber 210 or 202 relative to the atmospheric pressure. The measurement of pressure is then independent of changes in ambient air pressure.

A further modification to the embodiments of the present invention relating to the measuring device 200 of a dispensing device 64, is to impose a static constant gas pressure to the top to the chamber 201 or 202. A relatively constant gas pressure can be obtained by connecting the top of the chamber 210 to a large volume of gas under pressure. Where a pressure sensor 205 is used to produce a signal dependent upon the height of liquid in the chamber 210 or 202, it is preferred if the pressure sensor 205 senses the relative pressure with respect to the imposed static gas pressure. The higher gas pressure is advantageous when the liquid in the chamber 210 or 212 is very viscous and does not drain easily under gravity. The higher gas pressure assists the exhaustion of chamber 210, 202 by pump 210.

Figure 4:
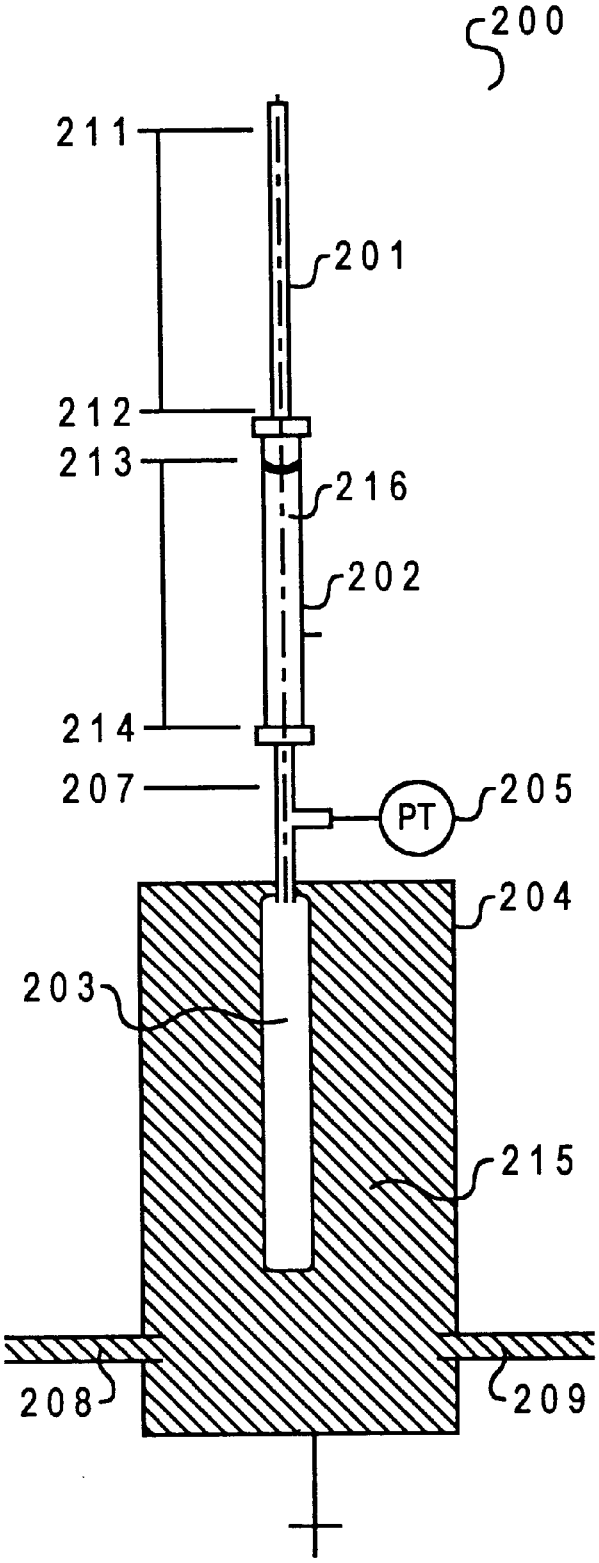
FIG. 4 is a schematic representation of yet another embodiment of a dispensing device in accordance with the present invention.

FIG. 4 shows schematically a further embodiment of the present invention. Reference numbers in FIG. 4 which are the same as in FIGS. 1 to 3 refer to the same components. In the measuring device 200 shown in FIG. 4, the liquid to be measured 216 is separated from the liquid to be dispensed 215 by a membrane 203. Membrane 203 may be rubber or may be very flexible thin metal formed into a bellows. The lower portion of chamber 210 is connected to a larger chamber 204 in which the membrane 203 is placed. As the pressure in chamber 204 sinks due to the operation of the pump 210 fluidly connected to outlet 209 of the chamber 204, the membrane 203 expands and the level of liquid 216 in chamber 201 or 202 falls accordingly. When the pressure rises in chamber 204 during filling, the membrane 203 shrinks in size according to the increased volume entering chamber 204 and the level of liquid 21 rises in chamber 210 or 202. The membrane 203 prevents contact between the ambient air and the liquid to be dispensed 215. Hence, this embodiment of the invention is usefull when the liquid 215 gives off toxic or harmful fumes or reacts with air.

Figure 5:
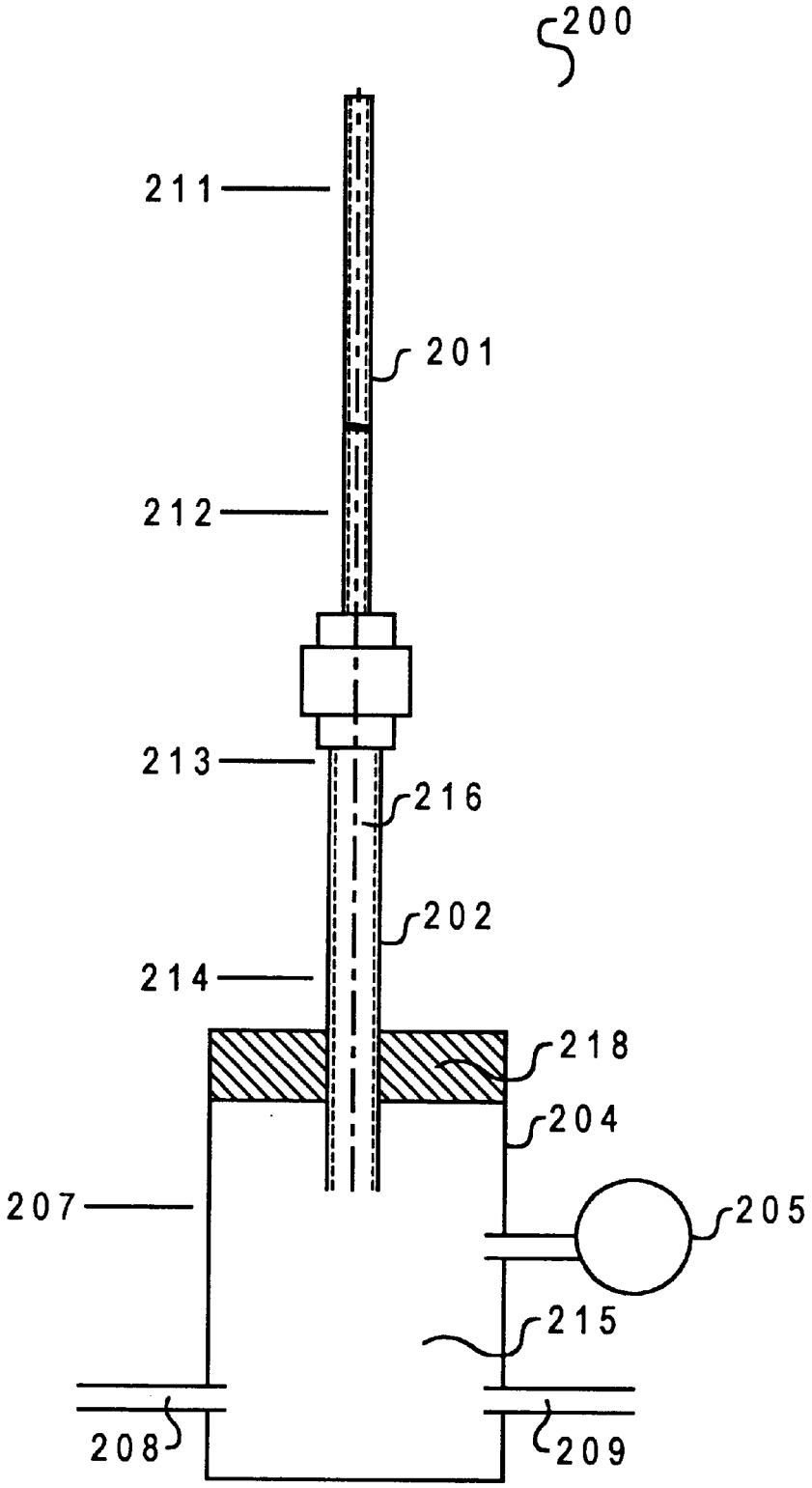
FIG. 5 is a schematic representation of still another embodiment of a dispensing device in accordance with the present invention.

FIG. 5 shows a further embodiment of the measuring device 200 in accordance with the present invention. Reference numbers in FIG. 5 which are the same as reference numbers in FIGS. 1 to 4 refer to the same components. One particular problem which can occur with piston displacement pumps is the pulsating variation of pressure at the pressure sensor 205 created by the pulsed flow through pump 210. This pulsation of pressure can be sensed by the pressure sensor 205 and may result in errors, particularly as the differential of the pressure signal is calculated by the feedback circuit 220 in order to output a signal representative of rate of change of height which is proportional to the rate of flow of liquid 215. In accordance with the present invention, this variation of pressure may be compensated for by an electronic pulsation damper, i.e. smoothing circuits in feedback control circuit 220 or by the equivalent software solution in control system 160. However, it has been determined by experiment that a mechanical pulsation damper is a simple and highly effective method of smoothing the signal from pressure sensor 205 and is particularly preferred in accordance with the present invention. The mechanical pulsation damper in accordance with the present invention is a compressible volume which is fluidly connected tc the chamber 201, 202 and to the pressure sensor 205 so as to substantially eliminate rapid pressure variations created by pump 210. In FIG. 5 the chamber 202 extends into the larger chamber 204. Pressure sensor 205 may be conveniently attached to chamber 234 and is in fluid contact with the liquid 215. At the top of chamber 204, above the liquid to be dispensed 215, a compressible gas volume 218 is provided. The gas may be air, or an inert gas such as nitrogen. The compressible volume 218 may also be introduced by means of a closed compressible bellows as is known from barometers not based on liquids such as mercury. The bellows can be simply placed in chamber 204. Pulsating pressures in chamber 204 created by the non-uniform flow through pump 210 are absorbed by elastic deformation of the compressible volume 218. The output of pressure sensor 205 is smoothed and does not show the pulsating waveform which can be experienced when there is a "hard" fluid connection between the inlet of the pressure sensor 205 and the pump 210. The volume of compressible volume 218 determines the effective spring constant of the mechanical pulsation damper and is preferably chosen so that the system does not resonate at any possible pump frequency.

Figure 7:
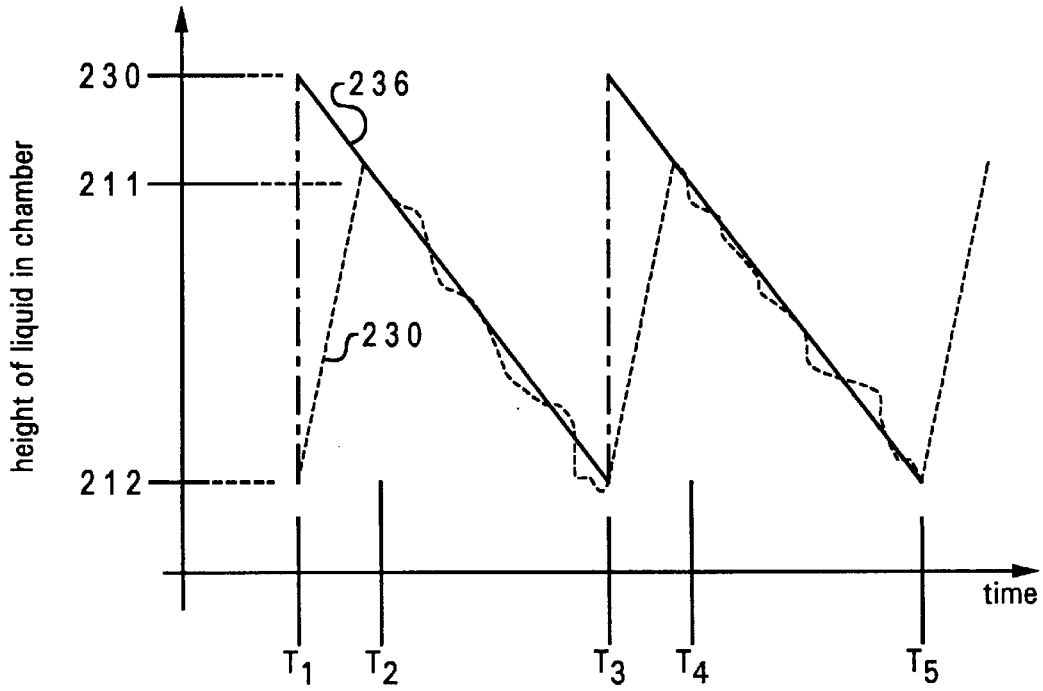
FIG. 7 is a schematic representation of a flow control procedure in accordance with another embodiment of the present invention.
Figure 8:
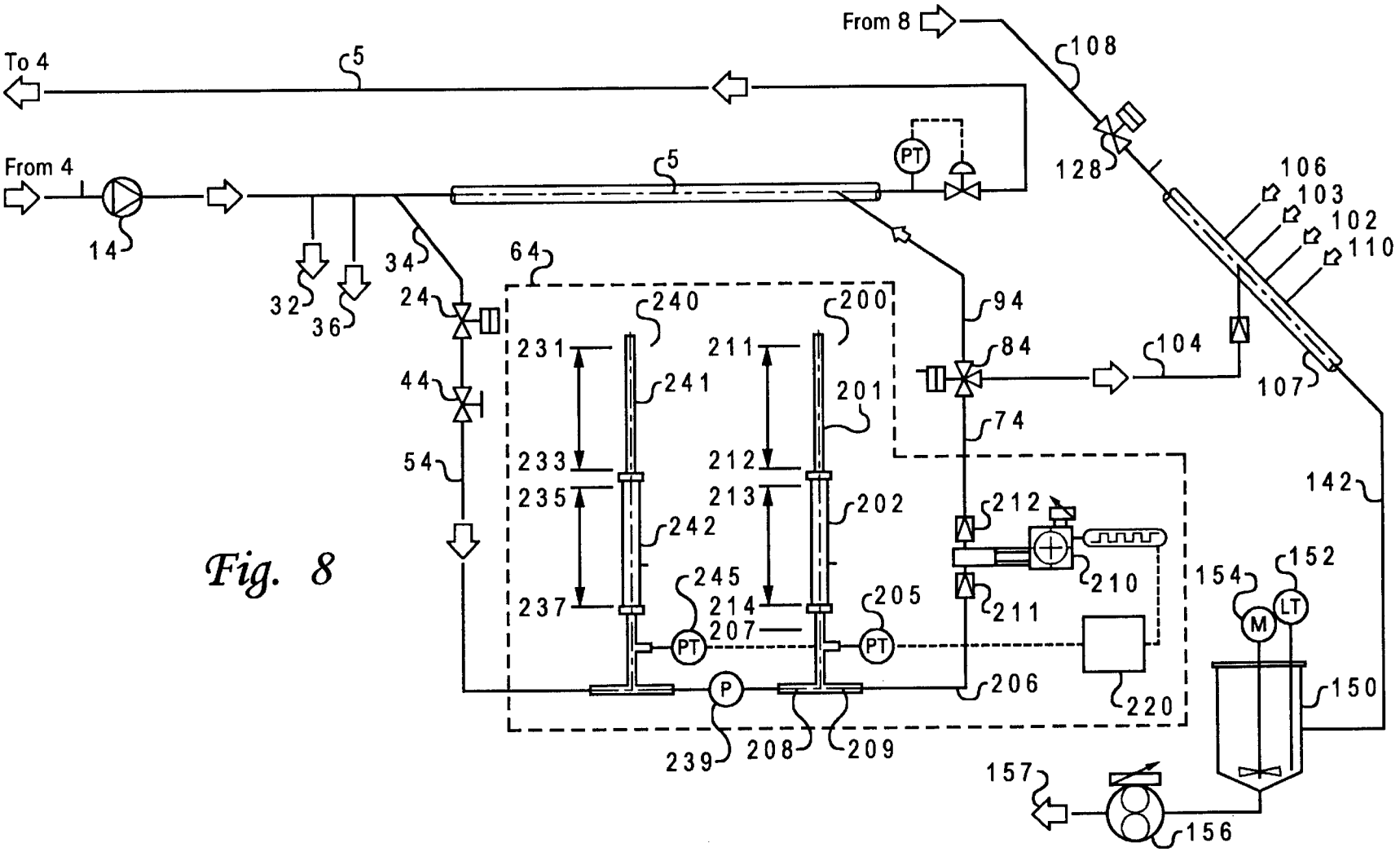
FIG. 8 is a schematic representation of another embodiment of an apparatus for controlling the printing of carpets in accordance with the present invention.

A further embodiment of the present invention will be described with reference to FIGS. 7 and 8. The components in Fig. which have the same reference numbers as in FIG. 2 have the same function and will not be described in detail. The disadvantage with the embodiment of the present invention described with reference to FIG. 7 is that the control circuit 220 has to estimate the amount of liquid which has flowed between time $T_1$ and $T_2$. In accordance with the present embodiment the amount of liquid transferred at each cycle is measured. As shown schematically in Fig, 8 a volume measuring device 240 is provided in addition to the measuring device 200. Instead of measuring device 200 being filled directly from conduit 5 it is filled from a volume measuring device 240 via pump 239. Volume measuring device 240 may conveniently be similar to measuring device 200 so if the upper chamber 201 of device 200 is being used, the volume is measured with an upper chamber 241 of device 240. Similarly if the lower chamber 202 of measuring device 200 is being used it is convenient to measure the volume with a lower chamber 242 of device 240. While measuring device 200 is aispensing liquid from chamber 210 or 202 via pump 210, volume measuring device 240 is filled from conduit 5 to a level 231 or 235 depending on which chamber is used. Once the level in chamber 201 or 202 reaches level 212 or 214, liquid is transferred from device 240 to 200 using pump 239. The exact starting level, e.g. 231 or 235 and finishing, level, e.g. 233 or 237 for measuring device 240 is determined by height sensor 245 and from the difference in these two levels the transferred volume can be calculated by control circuit 220 based on the cross-sectional area of the chamber 241 or 242. From this transferred volume, the control circuit 220 can calculate the equivalent height of liquid in measuring device 200 knowing the cross-sectional areas of chambers 210 or 202. This gives the position 230 in FIG. 7 as the start for one cycle. The control circuit 220 than calculates the theoretical fall in height 236 based on the predetermined flow and compares the actual readings 230 from sensor 205 of device 200 with the theoretical level 236 at any time between $T_1$ and $T_2$. As described with respect to FIG. 7 if there is a difference $\Delta h$ in these levels the pump 210 is adjusted to provide the predetermined flow.

In accordance with this embodiment a volume measuring device 240 is combined with a flow rate measuring device 200. From the sum total of all the volumes transferred by volume measuring device 240 over a time period the total dispensed volume can be recorded and if necessary controlled whereas dispensing device 200 accurately maintains the instantaneous flow rate at a predetermined value. Although this embodiment has been described with reference to FIG. 8, the present invention includes that the control of pump 210 may be by differentiating the height reading from sensor 205 to obtain a value representative of the instantaneous flow rate and to control the pump 210 based on this value as already described with reference to FIG. 2.

With all the embodiments of the measuring device 200 mentioned above the control system 160 can be arranged to emit an alarm if the level of the liquid in tube 201 and/or tube 202 reaches a dangerously low level such as 207 or to switch off pumps 210, alternatively to close down the complete system 1.

The system 1 in accordance with the present invention not only includes delivering pre-selected colored pastes to carpet printing equipment 158 but also to the general delivery of colored liquids for the printing, or painting, in particular spray painting of objects. In accordance with classical printing techniques, either a three color system, cyan, magenta and yellow (CMY) or a four color system using CMY and a black color (CMYK) can be used. Controllable amounts of the CMY or CMYK colors can be mixed to achieve a wide range of colors. In order to be able to provide a rich gamut of colors with fine nuances it is necessary to supply the three or four colored liquids CMY, or CMYK with a range of individual and independent flow rates of about 1 to 1000 or more. This can be achieved with the dispensing device 62, 63, 64, 66 in accordance with the present invention. With reference to FIG. 1 this may be achieved by placing each of the three or four color concentrates CMY or CMYK in one of the containers 2 to 4. In order to obtain the large range of flows necessary, more than one pump may be required for each line 32, 34, 36. As shown schematically in FIG. 1 with respect to dispensing devices 62 and 63, this may be achieved by providing appropriately dimensioned measuring devices 200 for each pump 210 to produce dispensing devices 62, 63 with different and preferably at least slightly overlapping flow rate ranges. The number of individual dispensing devices 62, 63 associated with each line 32, 33, 34, 36 may be freely chosen, and may, of course, be greater than 2. The desired color is then obtained by mixing the three or four colors in the continuous mixing chamber 107 with the addition of more solvents or other flowable materials, e.g. Wader from one or more of the containers 9, 10.

While the invention has been shown and described with reference to preferred embodiments, it will be understood by those skilled in the art that various changes or modifications in form and detail may be made without departing from the scope and spirit of this invention.

What we claim is:

1. Apparatus suitable for use in the continuous manufacture of coated, dyed, printed, or painted materials by dip coating, spraying or printing, said apparatus forming a colored flowable material from at least one liquid color concentrate and a plurality of other flowable materials comprising:

a plurality of conduits for feeding substantially continuously the flowable materials and the liquid colored concentrate from sources of the flowable materials and the liquid colored concentrate to a substantially continuous mixing chamber having a substantially continuous output of the colored flowable material;

at least the conduit carrying the liquid color concentrate to said mixing chamber including:

at least a first substantially vertical hollow chamber connected to the conduit;

a controllable pump device for pumping the liquid color concentrate having an inlet fluidly connected to an outlet of said first hollow chamber and an outlet leading to said mixing chamber;

a sensor for outputting substantially continuously a first signal dependent upon a height of a liquid in said first hollow chamber; and a control device for determining from said first signal whether the flowv rate of the liquid from said first hollow chamber is above or below a predetermined value and for controlling at least one flow rate determining characteristic of said controllable pump device in response to this determination so as to maintain the flow rate of the liquid color concentrate to be dispensed through said pump device at the predetermined value.

2. Apparatus according to claim 1, further comprising a second vertical hollow chamber fluidly connected to said at least one substantially vertical hollow chamber, said second chamber having a different cross-section than said at least one substantially vertical hollow chamber.

3. Apparatus according to claim 1, wherein said control device is adapted to derive a second signal representing the rate of change of height of the liquid in said first chamber from said first signal and for controlling said controllable pump in accordance with said second signal.

4. Apparatus according to claim 1, wherein said controllable pump device is a displacement pump.

5. Apparatus according to claim 4, wherein the characteristic of said controllable pump device controlled by the control device is the length of travel of the piston and/or the frequency of operation of the displacement pump.

6. Apparatus according to claim 1 wherein the liquid in the hollow chamber is the same as the liquid to be dispensed.

7. Apparatus according to claim 1, wherein said sensor is a pressure sensor.

8. Apparatus according to claim 1, further comprising a pulsation damper fluidly connected to at least said first substantially vertical hollow chamber and to said sensor.

9. An apparatus according to claim 1, further comprising a closed loss-free loop between the output of said controllable pump device and an inlet to said first hollow chamber for training or calibration; and a diverting means for diverting the flow of liquid from the closed loop of said dispensing apparatus to said mixing chamber without substantially changing the operation of said controllable pump device.

10. A method suitable for use in the continuous manufacture of coated, dyed, printed, or painted materials by dip coating, spraying or printing including forming a colored flowable material from at least one liquid color concentrate and a plurality of other flowable materials, comprising the steps of:

feeding the flowable materials and said liquid colored concentrate substantially continuously to a substantially continuous mixing chamber with a substantially continuous output of the colored flowable material;

dispensing said liquid color concentrate to said mixing chamber by the steps of: filling at least one substantially vertical hollow chamber with a liquid, generating substantially continuously a first signal dependent upon a height of a liquid in said substantially vertical hollow chamber;

determining from said first signal representative whether the flow rate of the liquid from said first hollow chamber is above or below a predetermined value;

operating a controllable pump device to reduce the level of liquid in the at least one substantially vertical hollow chamber; and controlling at least one flow rate determining characteristic of said controllable pump device in response to said determination so as to maintain the flow rate of the liquid colored concentrate to be dispensed through said pump device at the predetermined value.

11. Method according to claim 10, wherein the determining step includes deriving a second signal representative of the rate of change of height of the liquid in said first chamber and controlling said controllable pump in accordance with said second signal.

12. Method according to claim 10, wherein the pump device is controlled to deliver a constant weight of liquid colored concentrate per unit time period.

13. Method according to claim 10, wherein the pump device is controlled to deliver a constant volume of liquid colored concentrate per unit time period.

14. Method according to claim 10, wherein the dispensing step further comprises the steps of:

training or calibrating said pump device using a closed loss-free loop until stable; and diverting the flow from the pump device to the mixing chamber without substantially altering the operation of said pump device.

15. Apparatus for dispensing a liquid comprising:

a source for the liquid to be dispensed;

at least a first substantially vertical hollow chamber fluidly connected to said liquid source;

a controllable pump device having an inlet fluidly connected to an cutlet of said first hollow chamber for pumping the liquid to be dispensed;

a sensor for outputting substantially continuously a first signal dependent upon a height of a liquid in said first hollow chamber;

a control device suitable for determining from said first signal whether the flow rate of the liquid from said first hollow chamber is above or below a predetermined value and for controlling at least one flow rate determining characteristic of said controllable pump device in response to this determination so as to maintain the flow rate of the liquid to be dispensed through said pump device at the predetermined value;

a closed loss-free loop between the output of said controllable pump device and an inlet to said first hollow chamber for training or calibration; and a diverting means for diverting the flow of liquid from the close loop of said dispensing apparatus to an outlet without substantially changing the operation of said dispensing apparatus.

16. Apparatus for dispensing a liquid comprising:

a first substantially vertical hollow chamber;

a second vertical hollow chamber fluidly connected to said at least one substantially vertical hollow chamber, said second chamber having a different cross-section than said at least one substantially vertical hollow chamber;

a controllable pump device having an inlet fluidly connected to an outlet of said first hollow chamber for pumping the liquid to be dispensed;

a sensor for outputting substantially continuously a first signal dependent upon a height of a liquid in one of said first and second hollow chambers; and a control device suitable for determining from said first signal whether the flow rate of the liquid from said first hollow chamber is above or below a predetermined value and for controlling at least one flow rate determining characteristic of said controllable pump device in response to this determination so as to maintain the flow rate of the liquid to be dispensed through said pump device at the predetermined value.

17. Apparatus according to claim 16, further comprising a second vertical hollow chamber fluidly connected to said at least one substantially vertical hollow chamber, said second chamber having a different cross-section than said at least one substantially vertical hollow chamber.

18. Apparatus according to claim 16, wherein said control device is adapted to derive a second signal representing the rate of change of height of the liquid in said first chamber from said first signal and for controlling said controllable pump in accordance with said second signal.

19. A method of dispensing a plurality of liquids to an outlet using a dispensing apparatus comprising:

a source for the liquid to be dispensed;

at least a first substantially vertical hollow chamber fluidly connected to said liquid source;

a controllable pump device having an inlet fluidly connected to an outlet of said first hollow chamber for pumping the liquid to be dispensed;

a sensor for outputting substantially continuously a first signal dependent upon a height of a liquid in said first hollow chamber;

a control device suitable for determining from said first signal whether the flow rate of the liquid from said first hollow chamber is above or below a predetermined value and for controlling at least one flow rate determining characteristic of said controllable pump device in response to this determination so as to maintain the flow rate of the liquid to be dispensed through said pump device at the predetermined value;

a closed loss-free loop between the output of said controllable pump device and an inlet to said first hollow chamber for training or calibration; and a diverting means for diverting the flow of liquid from the close loop of said dispensing apparatus to an outlet without substantially changing the operation of said dispensing apparatus, the method comprising:

training or calibrating the dispensing apparatus using the closed loss-free loop until stable; and diverting the flow to the outlet from said dispensing apparatus without substantially altering the operation of said dispensing apparatus.

20. A method according to claim 19, further comprising the step of deriving a second signal representative of the rate of change of height of the liquid in said first chamber and controlling said controllable pump in accordance with said second signal.

* * * * *

UNITED STATES PATENT AND TRADEMARK OFFICE

CERTIFICATE OF CORRECTION

PATENT NO. : 6,010,032

DATED : January 4, 2000

INVENTOR(S) : Dirk Vermylen, et al.

It is certified that error appears in the above-identified patent and that said Letters Patent is hereby corrected as shown below:

Column 5 line 49, please change "continuosuly" to –continuously--.
Column 17 line 32, please change "flowv" to --flow-.
Column 18 line 52, please change "cutlet" to --outlet-.

Signed and Sealed this

Twenty-seventh Day of March, 2001

*Attest:*

*Attesting Officer*

Nicholas P. Godici

NICHOLAS P. GODICI

*Acting Director of the United States Patent and Trademark Office*